US006466225B1

(12) United States Patent
Larkin et al.

(10) Patent No.: US 6,466,225 B1
(45) Date of Patent: Oct. 15, 2002

(54) METHOD OF HALFTONING AN IMAGE ON A VIDEO DISPLAY HAVING LIMITED CHARACTERISTICS

(75) Inventors: Kieran Gerard Larkin, Putney; Peter William Mitchell Ilbery, Dundas; Michael Alexander Oldfield, Eastwood, all of (AU)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/299,592

(22) Filed: Apr. 27, 1999

(30) Foreign Application Priority Data

May 7, 1998 (AU) ..... PP3409

(51) Int. Cl.[7] ..... G09G 5/10

(52) U.S. Cl. ..... 345/596; 345/597; 345/598; 345/599; 345/690; 345/694; 345/696; 358/429; 358/455; 358/456; 358/457; 358/458; 358/459

(58) Field of Search ..... 345/690, 694, 345/696, 596–599; 358/429, 455–459

(56) References Cited

U.S. PATENT DOCUMENTS 5,109,282 A * 4/1992 Peli ..... 358/298
5,535,019 A 7/1996 Eschbach ..... 358/456
5,553,200 A * 9/1996 Accad ..... 395/109
5,734,369 A * 3/1998 Priem et al. ..... 345/155
5,805,126 A * 9/1998 Bassetti ..... 345/89
5,805,305 A * 9/1998 Abe ..... 358/457
5,986,640 A * 11/1999 Baldwin et al.
6,008,794 A * 12/1999 Ishii ..... 345/150
6,081,252 A * 6/2000 Reddy ..... 345/153
6,124,844 A * 9/2000 Ilbery ..... 345/596
6,130,661 A * 10/2000 Ilbery ..... 345/596

FOREIGN PATENT DOCUMENTS

AU 672648 7/1994
JP 2-155760 6/1990

* cited by examiner

*Primary Examiner*—Richard Hjerpe
*Assistant Examiner*—Henry N. Tran
(74) *Attorney, Agent, or Firm*—Fitzpatrick, Cella, Harper & Scinto

(57) ABSTRACT

A method of halftoning input image data intended for reproduction on a display (114) having a plurality of pixels (23–27) and a limited pixel response time (see FIG. 1) is disclosed. In a first halftone cycle (K=n), the method comprises (first) halftoning an input value (30) to display an extreme representable (100% or 0%). In a second halftone cycle (K=n+1), (second) halftoning the input value (30) to display an intermediate value such that the average of the extreme representable value and the intermediate value is substantially equal to the input value.

39 Claims, 11 Drawing Sheets

| K | 1 | 2 | 3 | 4 | 5 | 6 | 7 |
|---|---|---|---|---|---|---|---|
| $I_{in}$ | 100 | 100 | 100 | 200 | 200 | 200 | 200 |
| $I_{outl}$ | 0 | 200 | 0 | 144 | 255 | 144 | 255 |

METHOD OF HALFTONING AN IMAGE ON A VIDEO DISPLAY HAVING LIMITED CHARACTERISTICS

FIELD OF THE INVENTION

The present invention relates to halftoning and, in particular, to the halftoning of images intended for display on a video display having limited display characteristics.

BACKGROUND ART

Conventional liquid crystal displays (LCD's) for the display of video images normally display an array of dots at a fixed refresh rate. For example, one common form of display is a 640×480 display format. Video distribution standards, such as NTSC, assume a certain number of images will be presented every second. For example, a common rate is 60 fields per second which corresponds to a pixel update rate of 16.6 ms per pixel. Unfortunately, the response speed of currently available liquid crystals is highly variable and highly non-linear. For example, for a standard liquid crystal display, FIG. 1 illustrates observations made of the time for driving pixels of a continuous tone display from one intensity state to a second intensity state. It can be seen from examination of this data that, for a number of pixels the response time of the display is in excess of 16.6 ms. As a result, significant artefacts can be produced when a large amount of motion is present in a video signal when utilised to drive an LCD type display. The artefacts are often distractingly prevalent to the eye, especially where non-natural imagery is being displayed for example, moving objects having sharp borders, etc.

SUMMARY OF THE INVENTION

It is an object of the present invention to provide an alternative form of driving a display having limited response time characteristics so as to lead to improved display of images.

In accordance with a first aspect of the present invention, there is provided a method of halftoning input image data intended for reproduction on a display having a limited pixel response time comprising, for each pixel of the display, the steps of:

in a first halftone cycle, (first) halftoning an input value to display an extreme representable value; and in a second halftone cycle, (second) halftoning the input value to display an intermediate value such that the average of the extreme representable value and the intermediate value is substantially equal to the input value.

Preferably, each of the pixels of the display includes at least two sub-pixels which are driven with out-of-phase halftone cycles and adjacent pixels are driven in halftone cycles which are again out-of-phase with respect to one another such that, in each halftone cycle, there is formed a checkerboard pattern of extreme values of portions of the display.

Further, preferably the extreme values comprise a fully on pixel value and a fully off pixel value.

The method further preferably includes the step of detecting when the input value has changed around a midpoint value and altering the intermediate value to take into account the change so as to substantially maintain the average and further, overdriving the pixels during a fixed period for display of the pixels so as to produce a predetermined output intensity value of the pixels.

Other aspects of the invention including apparatus, system and computer readable medium are also disclosed.

BRIEF DESCRIPTION OF THE DRAWINGS

Notwithstanding any other forms which may fall within the scope of the present invention, preferred forms of the invention will now be described, by way of example only, with reference to the accompanying drawings in which.

DETAILED DESCRIPTION

Figure 1:
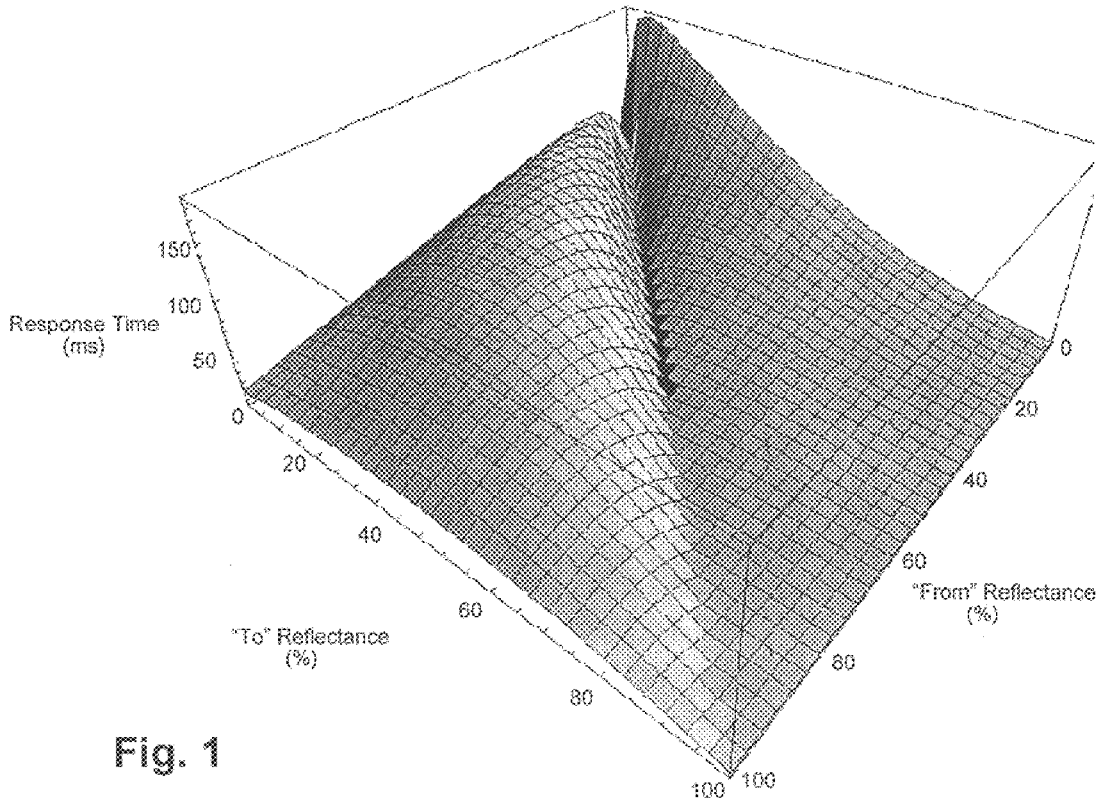
FIG. 1 illustrates a plot of response time between transitions of a standard liquid crystal display.

In the preferred embodiment, advantage is taken of a number of characteristics of the display through the utilisation of the structure of the measurements as hereinbefore discussed and illustrated with respect to FIG. 1. These characteristics include the following:

1. The first important observation is that all transitions to white (100%) appear to be very fast (between 1.2 ms and 5.9 ms).

2. The second observation is that all transitions to black (0%) are reasonably fast (between 9.6 ms and 15.8 ms). For a system with 60 fields per second, such transitions satisfy the 16.6 ms limit per pixel.

3. The third observation is that transitions from white to grey are slow but the transition from white to black is fast (13.2 ms), so that intermediate transitions could be made faster by an extra boost to the display driving signal.

4. The fourth observation is that transitions from black to grey are slow but the biggest transition (from 0% to 100%) is fast (5.9 ms), so that intermediate transitions can be improved by an extra boost to the display driving signal.

Observations 3 and 4 can be made because the transition value matrices are assumed to be modelled by continuous and monotonic functions defining actual transitions achieved for various inputs values. This model can be based on the data set provided.

5. The fifth and last observation regarding the matrix table data is that, in general, grey to grey (GTG) transitions are slow. In particular, a large percentage of GTGs take more than 16.6 ms. Hence, such transitions should be generally avoided.

As a result of the observations it is possible to state a number of desirable objectives of a candidate halftoning method: A first is to halftone (or partially-tone) the display image so that only fast transitions occur. An additional objective can also be to try to ensure that the halftone structure has minimal visual impact (or that the visual quality is to be maintained up to the highest spatial and temporal frequencies).

The method of the preferred embodiment works by ensuring that only the following transitions can occur:

Grey to white transition (very fast).

Grey to black transition (fast).

White to grey (not so fast, but calibrated to be just fast enough).

Black to grey (not so fast, but calibrated to be just fast enough).

Figure 2A:
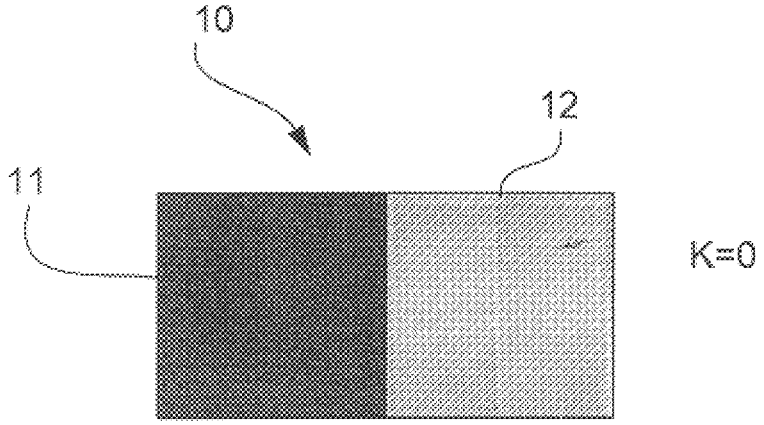
FIGS. 2A–2C illustrate the operation of single pixels within the preferred embodiment.
Figure 2B:
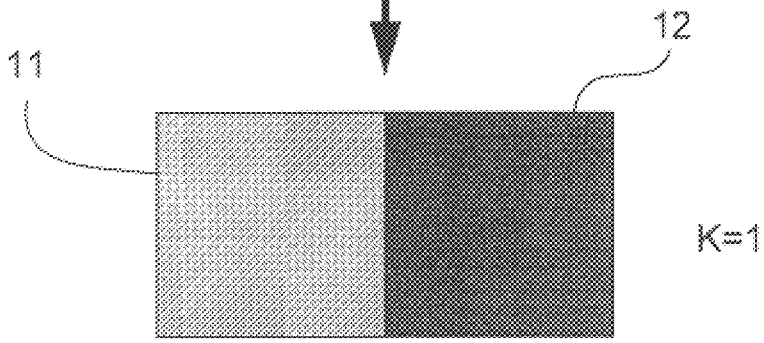
Figure 2C:
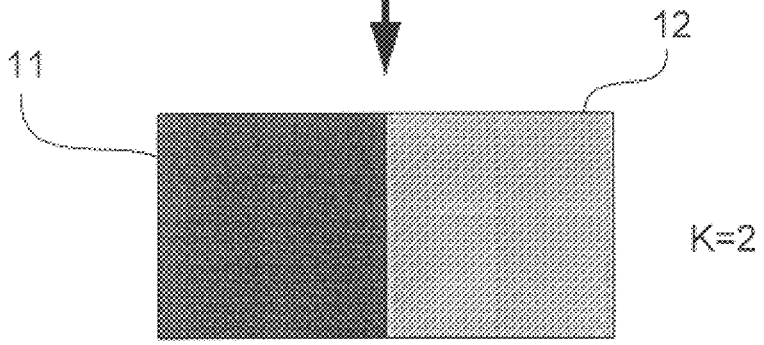
Figure 3:
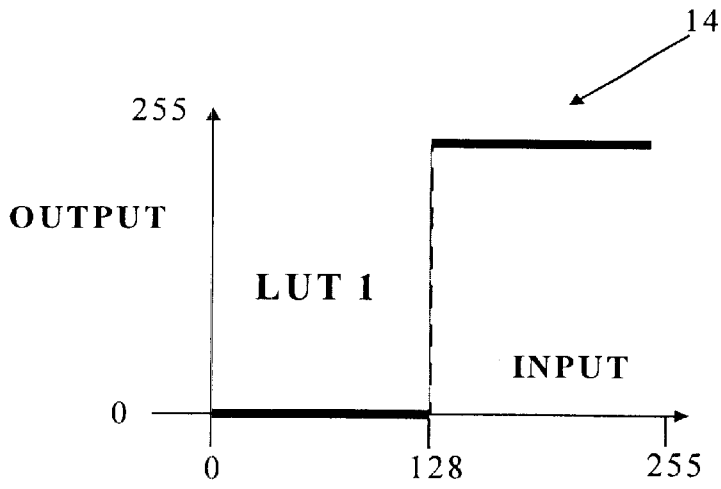
FIG. 3 illustrates a plot of values retained in a first lookup table utilised with the preferred embodiment.

In the preferred embodiments, each pixel of the display is divided into two sub-pixel components. It is however not essential for each pixel to be divided into two sub-pixels, as the preferred embodiments represent only a number of possible implementations. For example, as shown in FIG. 2A, a single pixel 10 is divided into separate components 11 and 12. Within each video field, one of the sub-pixels 11,12 is driven to an extreme state of either fully on or fully off. For example, in a first field (K=0) depicted FIG. 2A, the sub-pixel 11 is depicted having being driven to a fully off state. In a next field (K=1), the opposite sub-pixel 12 is driven to an extreme state as indicated in FIG. 2B. Subsequently in FIG. 2C, in the next field (k=2), the first sub-pixel 11 is again driven to an extreme state. The corresponding values used in a (first) lookup table (LUT) for driving pixels to an extreme state is as indicated in FIG. 3, with, for a given input, the output being one of two extremes, either 0 or 255, in an 8-bit data arrangement.

Figure 4:
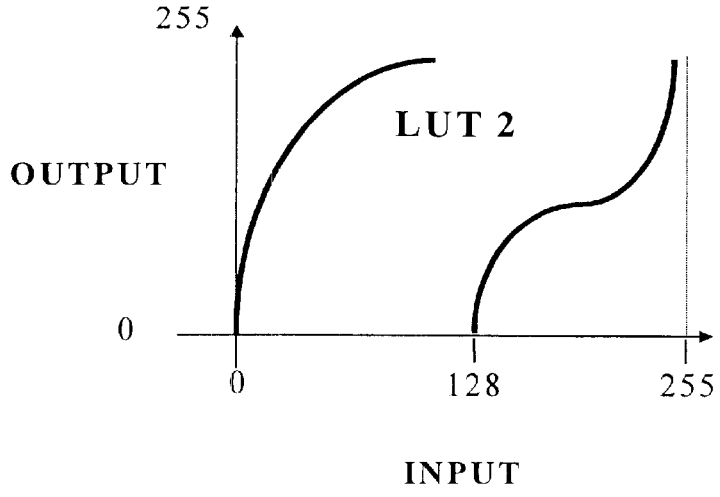
FIG. 4 illustrates a plot of values retained in a second lookup table as utilised in the preferred embodiment.

While one of the sub-pixels 11, 12 is being driven to an extreme state, in the normal case, the other sub-pixel is driven from its previous extreme state to a level such that the errors produced by a halftoning from pixel to pixel from field to field cancel out over local pixel regions over time. A corresponding (second) lookup table for the intermediate state sub-pixel may be formed having values as illustrated in FIG. 4. The second lookup table effectively results in the intermediate sub-pixel being over driven so as to reach an output intensity value about twice that of the input for values ranging from 0–127, and to about twice the input value less 255 for values between 128–255. Hence, in consecutive fields, the average output of each sub-pixel 11 will be substantially equivalent to an overall intensity of the pixel 10 when the intensity of the pixel does not change.

Figures 5, 6:
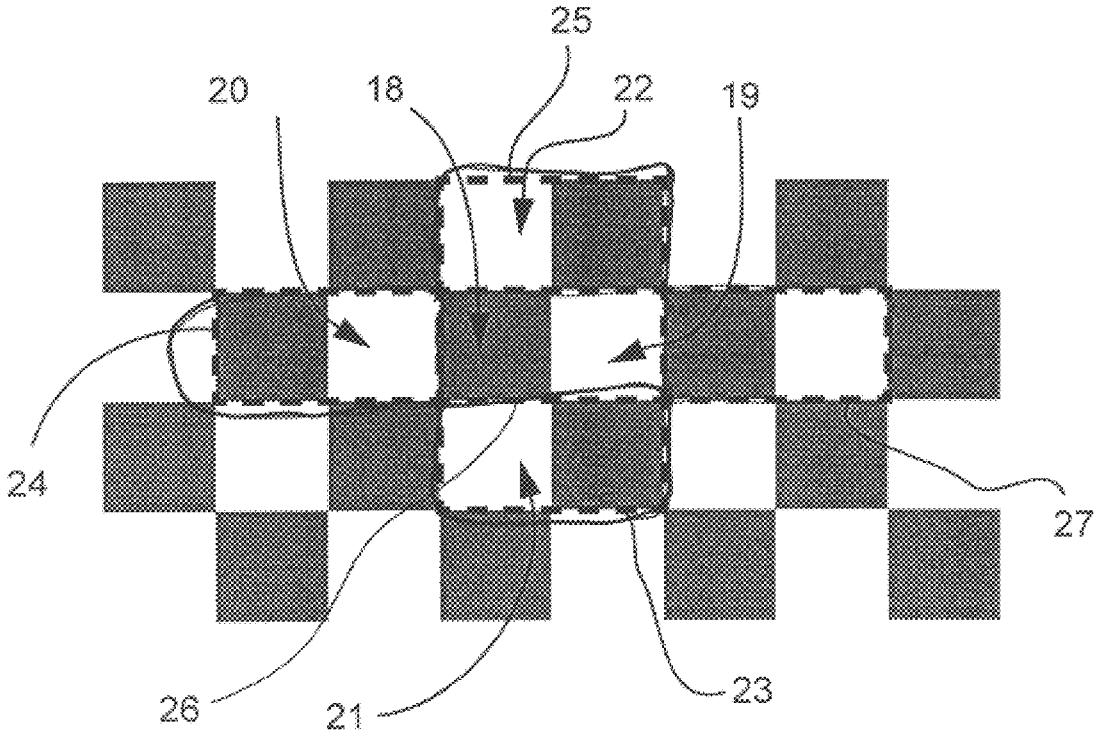
FIG. 5 illustrates an array of pixels and sub-pixels as operated in accordance with the preferred embodiment.
FIG. 6 illustrates a table of a particular problematic example occurring with the preferred embodiment.

Turning to FIG. 5, a number of adjacent pixels 23, 24, 25, 26 and 27 are shown indicated by heavy dashed lines. Each of the pixels 23, 24, 25, 26 and 27 is formed by two horizontally adjacent sub-pixels (e.g. the sub-pixels 18, 19 together form the pixel 26) which are driven in such a manner that alternating adjacent sub-pixels are driven to an extreme value so as to produce a checkerboard of extreme values in any particular field cycle. Hence, when sub-pixel portion 18 of pixel 23 is driven to an extreme value, surrounding sub-pixel portions 19, 20, 21 and 22 are driven to their corresponding intermediate values. Therefore, each region, although changing at a high frequency, displays, over time, an average intensity equivalent to the intensity of the region.

It was found in experiments conducted by the inventors that the arrangement as depicted in FIG. 5 provided superior results for stable images. However, a remaining artefact occurred where the region was rapidly changing in value and, in particular, when a pixel value changed around an intermediate intensity from one field to the next. Further investigation revealed that the artefact was due to a historical assumption made which did not hold when a pixel intensity value varied around a mid point value. The assumption was found to cause artefacts as can be seen from the example illustrated in FIG. 6, which illustrates a table of input intensity values ($I_{in}$) for a series of fields (K) numbered 1–7. It is assumed that the input intensity ($I_{in}$) undergoes an abrupt jump from 100 to 200 between fields 3 and 4. The output intensity of a sub-pixel ($I_{out}$) would originally be alternating between intensity values of 0 and 200. In field 4, when utilising the above method, it would be assumed that the previous maximum in field 3 was 255 rather than 0. As a result, the value of 144 would be output. Consequently, the average of frames 3 and 4 will be 72, which is well below the input intensity values over this range. Hence, a likely artefact will be displayed when the input intensity values are changing around the mid-point as illustrated in this example. A similar artefact will also occur for the symmetrically opposite case where the input value goes from, for example 200 to 100 in intensity value. In general, such an artefact will be very brief and may be ignored.

Figure 7:
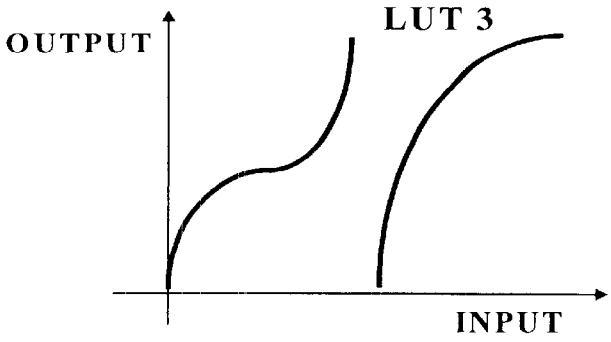
FIG. 7 illustrates a plot of values retained in a third lookup table utilised in accordance with the preferred embodiment.

Alternatively, one method of overcoming this problem is to detect the case where an intensity changes around the mid-point and to utilise a separate lookup table for this case. An example (third) lookup table is illustrated in FIG. 7 with the lookup table producing improved results. In the simplest case, LUT 3 can be derived from LUT 2 by interchanging the lower and upper parts of the LUT graph. A range of lookup tables can be utilised to deal with this special case. Further, the lookup tables can be distorted so as to take into account the response times of the display.

The overall preferred method therefore works on a 2-state checkerboard (odd/even) structure. The odd/even states alternate from field to field as well as from pixel to pixel. The main idea is to get the errors produced from halftoning to change phase (anti-phase) from pixel to pixel and from field to field in order to cancel out (average to zero) over local pixel regions and over time. In this way, fast transitions are maintained, but the halftone noise introduced is not easily perceptible.

The method ensures that any noise introduced is of a very high spatio-temporal frequency, and therefore not visually perceptible. The checkerboard is a structure with a high level of change between states and can produce frequency components at the highest spatio-temporal frequencies.

The checkerboard can be defined by a logical decision on the pixel (i,j) and field (k) indices which are divided into odd and even groups as follows:

$$i+j+k=\text{even}$$

$$i+j+k=\text{odd}.$$

The checkerboard group is used to decide which LUT to use for each pixel in each field. Essentially the pixels alternate between LUT1 and LUT2. Occasionally when a mid-point transition occurs, LUT3 is needed to avoid the wrong calibration being used.

Figure 8:
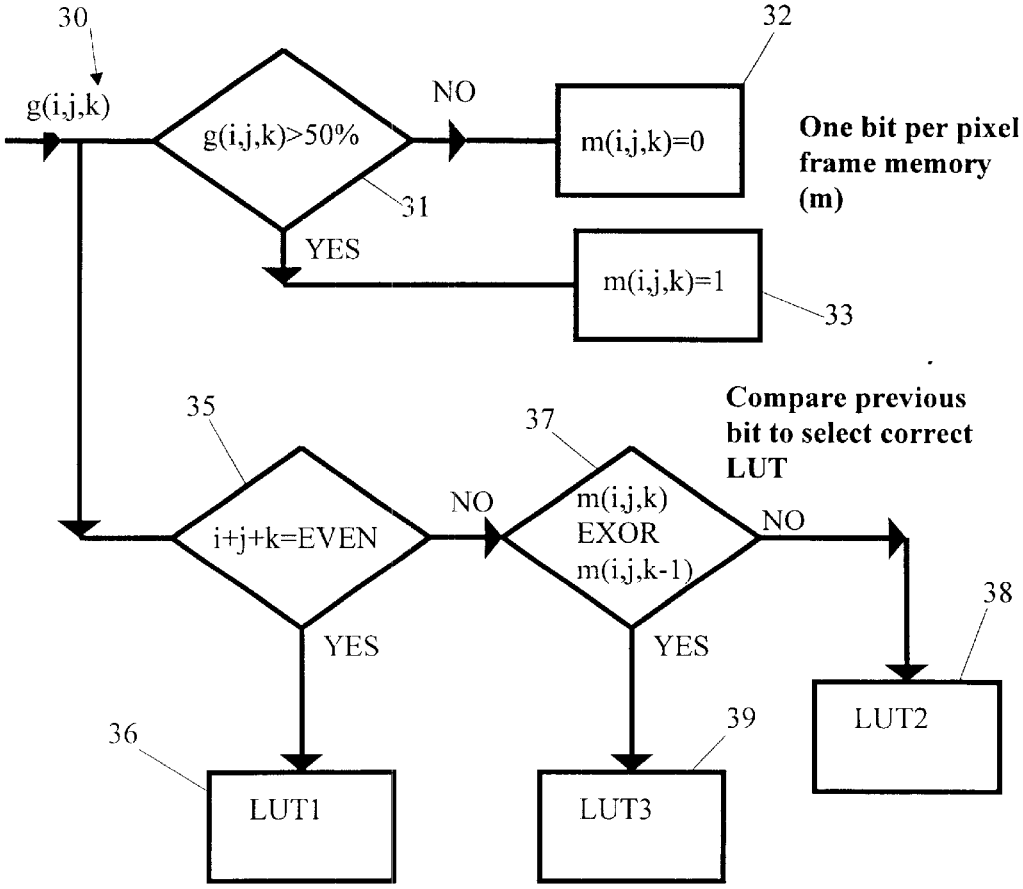
FIG. 8 illustrates a flow chart of the algorithmic steps of the preferred embodiment.

A flow chart of the method utilised is indicated in FIG. 8. An input pixel value 30 denoted g(i, j, k) is processed at step 31 to determine whether its intensity exceeds 50% and a corresponding bit is stored at steps 32 and 33 depending on the result in a 1 bit per pixel frame memory (M). Simultaneously, a parity check is carried out at step 35. If the parity is even, the first lookup table is utilised in step 36. If the parity is not even, then a check is carried out at step 37 to determine whether a mid-point traversal has occurred. If no midpoint traversal has occurred, lookup table 2 is utilised in step 38, otherwise lookup table 3 is utilised in step 39.

It can be seen from the foregoing discussion that the choice of LUT is such that the average grey level for a pixel over any two sequential fields is close to the input level. The average for any two adjacent pixels also tends to be accurate (if the grey level gradient is small). The method also produces two interlaced images, in which the interlacing is a checkerboard structure in 3 dimensions (2D space and 1D time). Both interlaced images are under-sampled by a factor of 2 resulting in some potential image degradation caused by aliasing. Some degradation may also be caused by the non-linear form of the LUT's. Both types of degradation tend to cancel out over small space and time intervals. The error noise further appears in the high spatio-temporal frequencies which are strongly attenuated by the human visual system.

Figure 9:
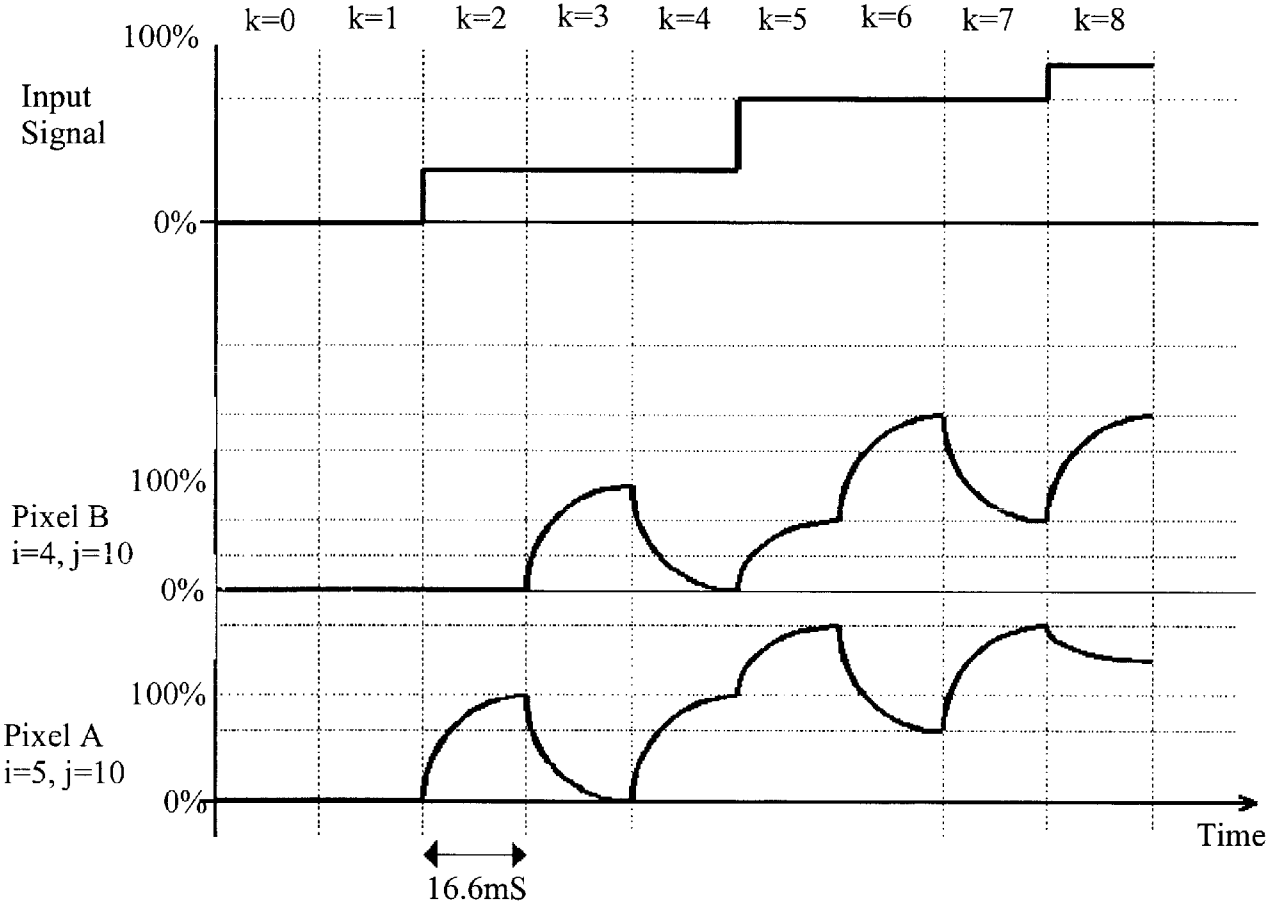
FIG. 9 illustrates example pixel operation when utilising the preferred embodiment.

Additionally calibrated LUT's are preferably used to ensure that the pixel transitions occur in the time available (16.6 ms). To understand the operation of the method, consider the effect of a hypothetical input signal on the output of two adjacent pixels where the output display is assumed to have an exponential response characteristic ($1-e^{-at}$). The response for an increasing input signal will be substantially as depicted in FIG. 9 and also set out in Table 1 below:

TABLE 1

| k = | INPUT | M (4, 10, k) | PIXEL A | m (5, 10, k) | PIXEL B |
|---|---|---|---|---|---|
| 0 | 0 | 0 | 0% LUT2 | 0 | 0% LUT1 |
| 1 | 0 | 0 | 0% LUT1 | 0 | 0% LUT2 |
| 2 | 30% | 0 | 60% LUT2 | 0 | 0% LUT1 |
| 3 | 30% | 0 | 0% LUT1 | 0 | 60% LUT2 |
| 4 | 30% | 0 | 60% LUT2 | 0 | 0% LUT1 |
| 5 | 70% | 1 | 100% LUT1 | 1 | 40% LUT3 |
| 6 | 70% | 1 | 40% LUT2 | 1 | 100% LUT1 |
| 7 | 70% | 1 | 100% LUT1 | 1 | 40% LUT2 |
| 8 | 90% | 1 | 80% LUT2 | 1 | 100% LUT1 |

Figure 14:
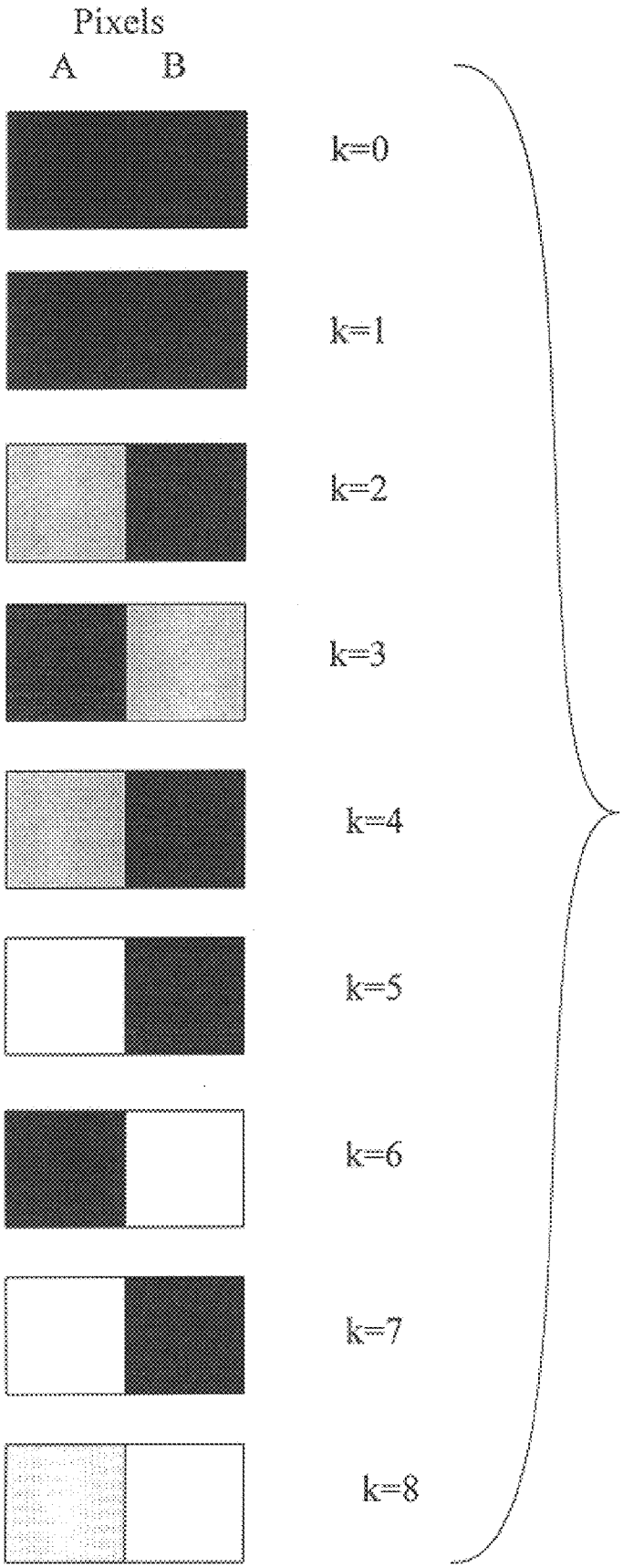
FIG. 14 depicts a display of pixels A and B for the sequence of FIG. 9.

The various changes of the two pixels A and B for the fields K=0–8 is shown in FIG. 14.

As previously noted, LUT3 is only needed when the input crosses the 50% threshold, and it ensures that the correct calibration is used. For example, between fields k=4 and k=5 there is a 50% crossing so that LUT 3 is selected for pixel B. As noted previously, a one bit per pixel frame buffer is needed to store the previous value of the parameter m=m(i, j,k−1).

For any point in time, the average value of pixels A and B is equal to the input value. In fact, this is true for the final value reached at the end of a given time interval, but the exponential transition shape seen generally in FIG. 9 may mean that an additional calibration adjustment is needed if the time averaged value is required to be correct.

Preferably, two calibrations are performed as follows:

1. for white to grey transitions.
2. for black to grey transitions.

Figure 10:
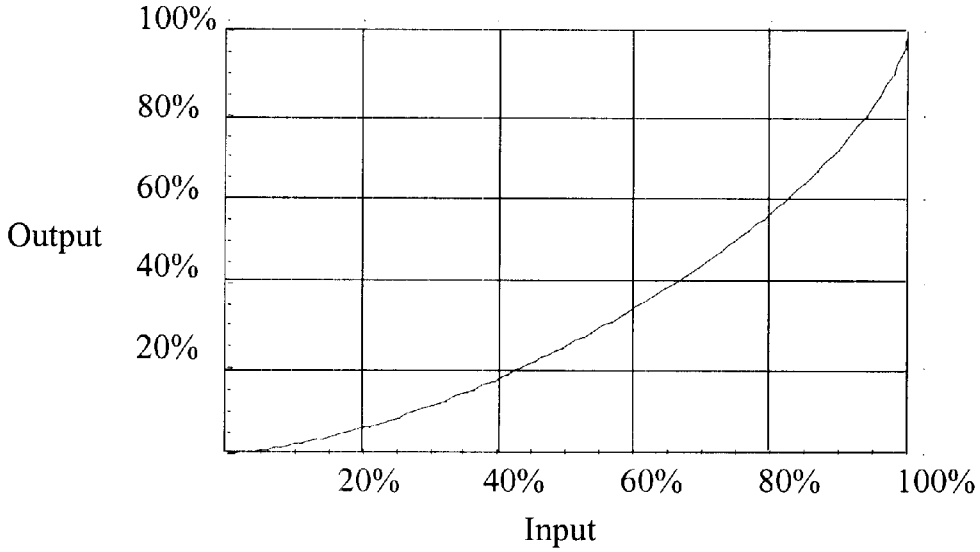
FIGS. 10 and 11 illustrates the input/output graph for standard transition times for pixels which are initially black and white.

An initial model utilised ignored the time averaging of grey levels over the transition time (16.6 ms for NTSC fields) and calibration was carried out to just allow full transition in the allocated time. FIG. 10 shows a typical example of the actual output from an LCR panel as various inputs are applied to a pixel that is initially black.

Figure 11:
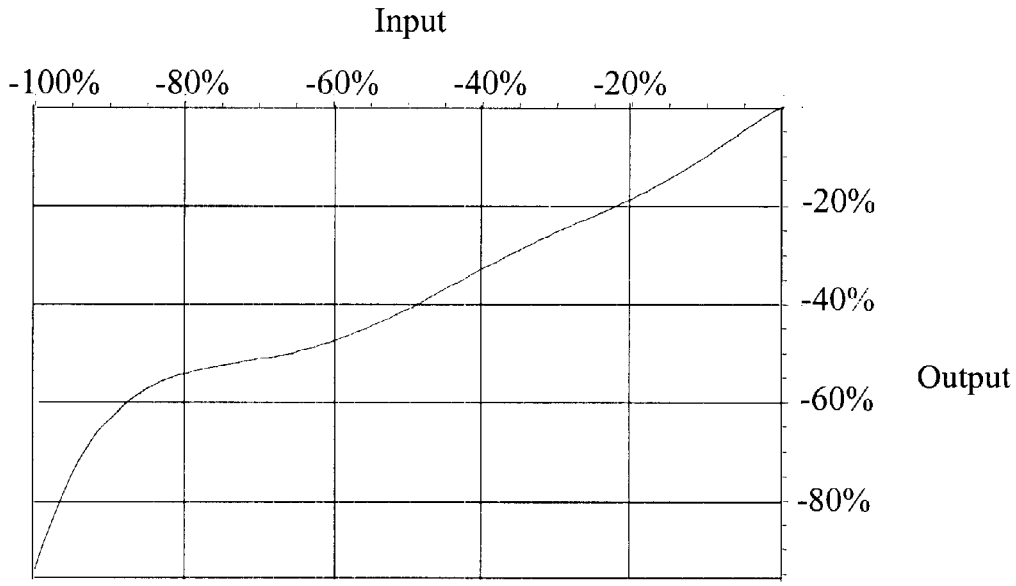

Similarly FIG. 11 shows the change in actual output from an LCD panel as various input changes are applied to a pixel that is initially white.

By approximating the response curves of FIGS. 10 and 11 as piece-wise linear, continuous curves it is possible to generate a LUT which gives the input required to achieve any desired output (inversion). These values can then be used in LUT2 and LUT3.

Careful study of FIG. 11 shows that transitions from white (100%) to grey levels below about 6% (40) are not quite possible (ie.—94 transition). However this does not cause noticeable error in average grey level.

Figure 12:
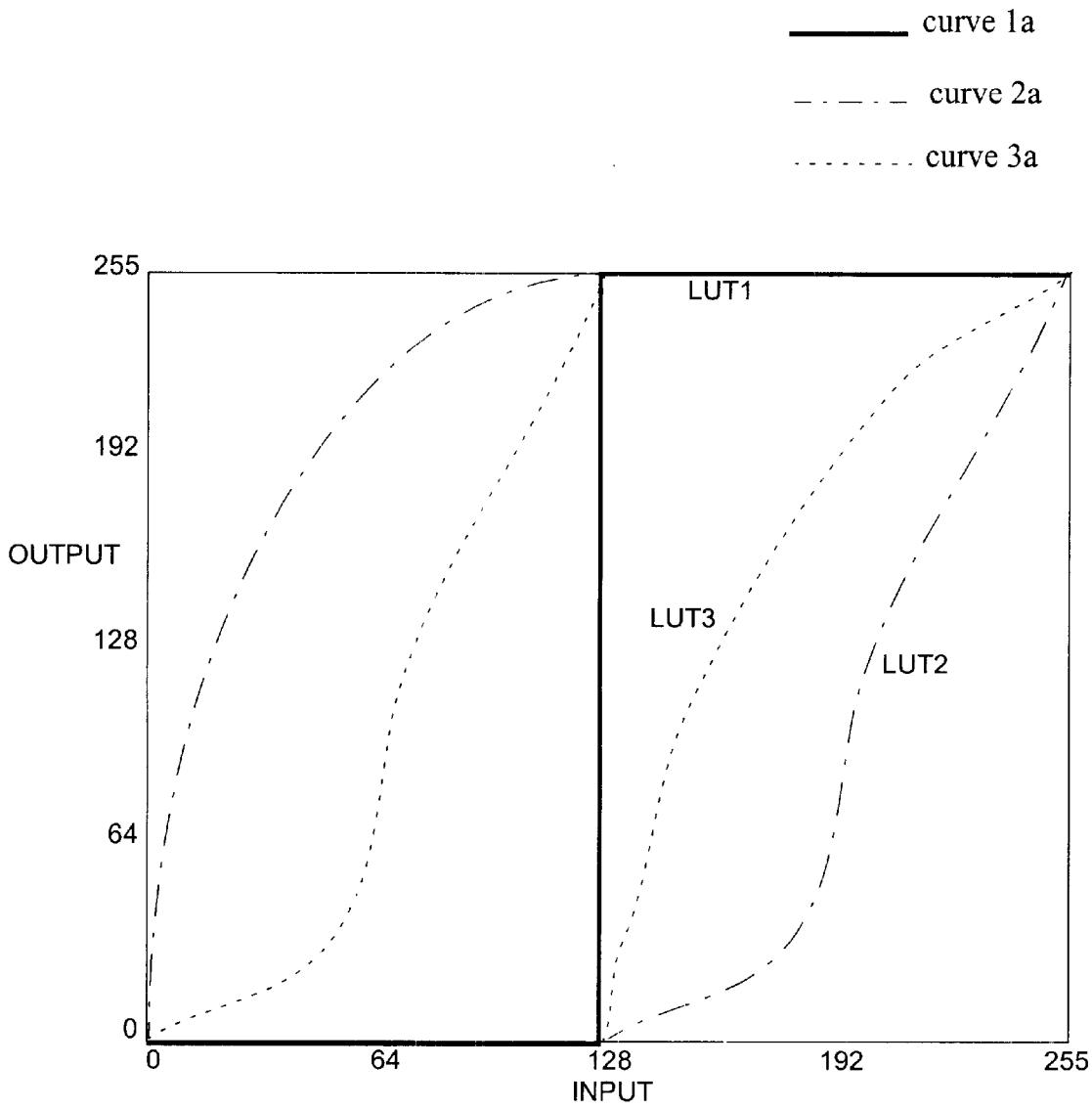
FIG. 12 illustrates plot of values retained in one form of final lookup table as utilised in the preferred embodiment.

Finally, in FIG. 12, there is illustrated example final calibrated lookup tables produced from the input-output graphs of FIGS. 10 and 11.

From the foregoing, it will be appreciated that, under its direct application, the method of the preferred embodiment is unlikely to actually achieve, over time, the situation where the average of the displayed pixel intensity is the same as the input pixel intensity. This is because an average taken over time of values that are constantly changing will never reach a steady state. However, over time the average, according to the described embodiments, does clearly approach and thus is substantially the same as the input value. Where desired, the calibration adjustment discussed above may be applied to provide any further level of correction to the displayed value.

The method outlined has the added advantage that it eliminates hysteresis effects in the LCD panel because the transition history of every pixel is known. In particular, every grey level occurring at a particular pixel must have been preceded by (in the previous field) either a white (100%) or a black (0%). The calibration curves inherently contain hysteresis information.

Figure 13:
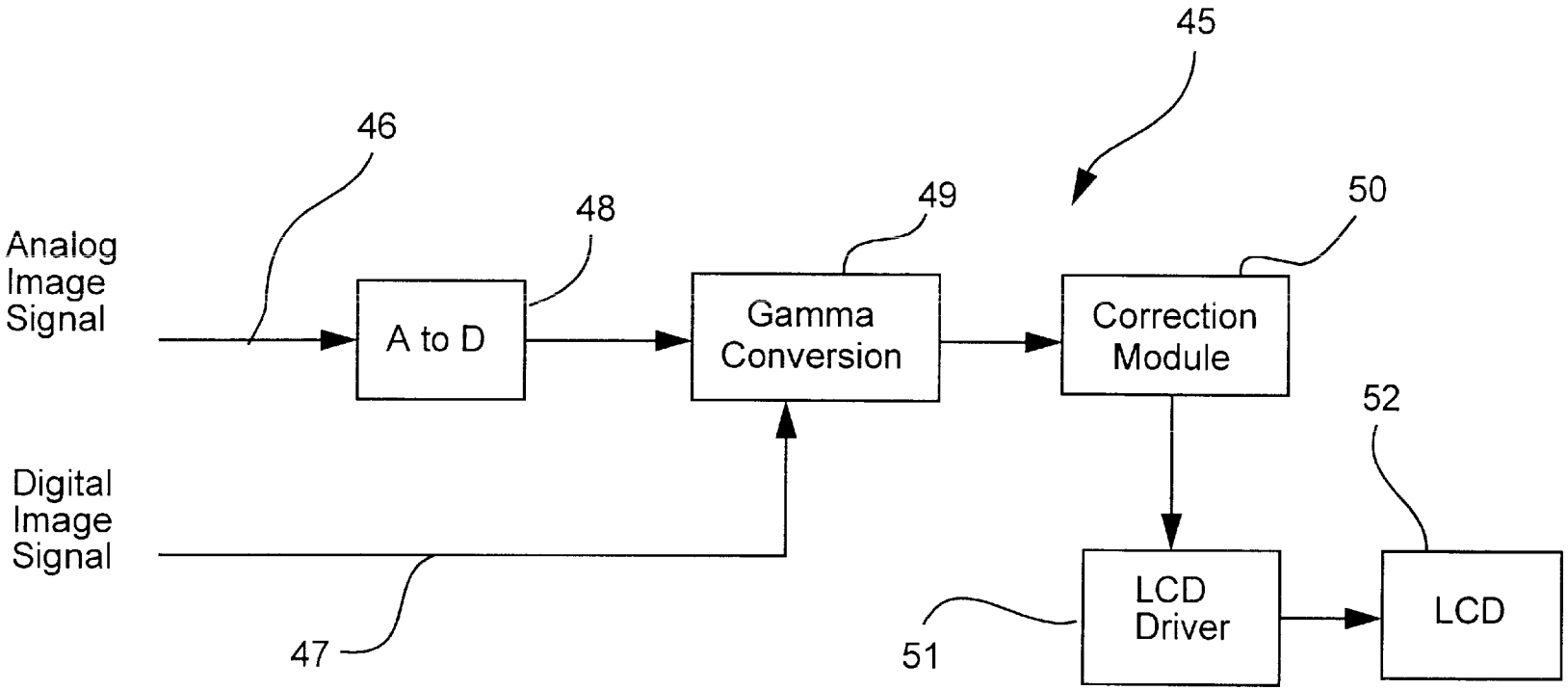
FIG. 13 illustrates one form of the preferred embodiment when utilised to drive a liquid crystal display.

Turning now to FIG. 13, there is illustrated an exemplary system 45 for utilisation with the method of the preferred embodiment. The system 45 is able to accept either analogue 46 or digital 47 signal inputs. The analogue input 46 initially is analogue-to-digital converted by analogue-to-digital converter 48, before being forwarded, like digital signal 47, to gamma conversation circuit 49, which can operate using a dedicated lookup table. Next, a correction module 50 implements the method of the preferred embodiment to output pixel value to an LCD driver 51 for display on LCD 52. The correction module 50 includes the three halftoning lookup tables described above, and a 1-bit per pixel memory buffer utilised to detect midpoint crossings. The correction module 50 also includes associated logic so as to implement the flow chart of FIG. 8. The modules 48, 49 and 50 may be formed within a computer system or alternatively formed within and specifically adapted to the particular display 52.

As indicated previously, it is not necessary for each pixel to be divided into 2 sub-pixels. For example, where each pixel is formed by a single display element, the alternating checkerboard between adjacent pixels ensures a correct local averaged output.

Although the above described embodiments relate to monochrome examples of halftoning, the same processes can be applied to a colour display system. In particular, where the colour display system uses the red, green and blue (RGB) format, the methods described may be applied to the individual color channels used in that format. As a consequence, for example, if each colour pixel includes a single sub-pixel for each of red, green and blue, the checkerboard pattern is applied to each colour across each pixel such that adjacent blue sub-pixels alternate, as do those for red and green.

Figure 15:
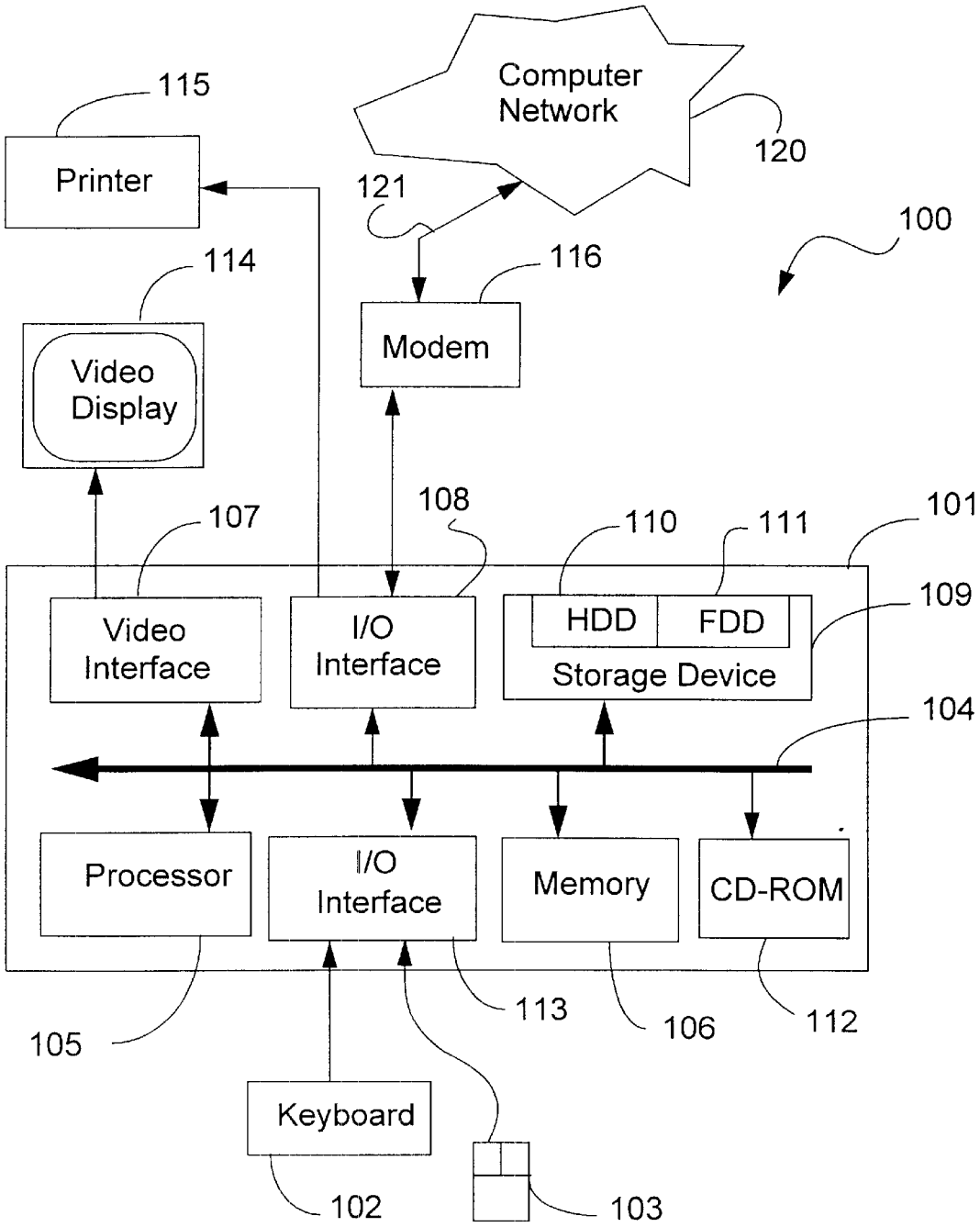
FIG. 15 is a schematic diagram of a computer system in which the described embodiments may be practised.

The methods of the described embodiments are preferably practiced using a conventional general-purpose computer system 100, such as that shown in FIG. 15, wherein the methods may be implemented as software, such as an application program, executing within the computer system 100. In particular, the steps of the methods are effected by instructions in the software that are carried out by the computer. The software may be divided into two separate parts; one part for carrying out the methods; and another part to manage the user interface between the latter and the user. The software may be stored in a computer readable medium, including the storage devices described below, for example. The software is loaded into the computer from the computer readable medium, and then executed by the computer. A computer readable medium having such software or computer program recorded on it is a computer program product. The use of the computer program product in the computer preferably effects an advantageous apparatus in accordance with the embodiments of the invention.

The computer system 100 comprises a computer module 101, input devices such as a keyboard 102 and mouse 103, output devices including a printer 115 and a display device 114. The display device 114 is typically a device having limited display characteristics such as the LCD's discussed above. A Modulator-Demodulator (Modem) transceiver device 116 is used by the computer module 101 for communicating to and from a communications network 120, for example connectable via a telephone line 121 or other functional medium. The modem 116 can be used to obtain access to the Internet, and other network systems, such as a Local Area Network (LAN) or a Wide Area Network (WAN).

The computer module 101 typically includes at least one processor unit 105, a memory unit 106, for example formed from semiconductor random access memory (RAM) and read only memory (ROM), input/output (I/O) interfaces including a video interface 107, and an I/O interface 113 for the keyboard 102 and mouse 103 and optionally a joystick (not illustrated), and an interface 108 for the modem 116. A storage device 109 is provided and typically includes a hard disk drive 110 and a floppy disk drive 111. A magnetic tape drive (not illustrated) may also be used. A CD-ROM drive 112 is typically provided as a non-volatile source of data. The components 105 to 113 of the computer module 101, typically communicate via an interconnected bus 104 and in a manner which results in a conventional mode of operation of the computer system 100 known to those in the relevant art. Examples of computers on which the embodiments can be practised include IBM-PC's and compatibles, Sun Sparcstations or alike computer systems evolved therefrom.

Typically, the application program of the preferred embodiment is resident on the hard disk drive 110 and read and controlled in its execution by the processor 105. Intermediate storage of the program and any data fetched from the network 120 may be accomplished using the semiconductor memory 106, possibly in concert with the hard disk drive 110. In some instances, the application program may be supplied to the user encoded on a CD-ROM or floppy disk and read via the corresponding drive 112 or 111, or alternatively may be read by the user from the network 120 via the modem device 116. Still further, the software can also be loaded into the computer system 100 from other computer readable media including magnetic tape, a ROM or integrated circuit, a magneto-optical disk, a radio or infra-red transmission channel between the computer module 101 and another device, a computer readable card such as a PCMCIA card, and the Internet and Intranets including email transmissions and information recorded on websites and the like. The foregoing is merely exemplary of relevant computer readable mediums. Other computer readable mediums may be practiced without departing from the scope and spirit of the invention.

The methods of the described embodiments may alternatively be implemented in dedicated hardware such as one or more integrated circuits. Such dedicated hardware may include graphic processors, digital signal processors, or one or more microprocessors and associated memories.

It is also relevant that the operation of the preferred embodiment results in a compression of the required display signal by a factor of almost two. This compression factor can be utilised to reduce the bandwidth of any display utilising the schema of the present invention.

It would be appreciated by a person skilled in the art that numerous variations and/or modifications may be made to the present invention as shown in the specific embodiments without departing from the spirit or scope of the invention as broadly described. The present embodiments are, therefore, to be considered in all respects to be illustrative and not restrictive.

What is claimed is:

1. A method of halftoning input image data intended for reproduction on a display having a plurality of pixels and a limited pixel response time, said method comprising, for each pixel of said display, the steps of:

in a first halftone cycle, (first) halftoning an input value to display an extreme representable value, the extreme representable value being a fixed value at the extreme end of a range of input values; and in a second halftone cycle, (second) halftoning said input value to display an intermediate value such that the average of said extreme representable value and said intermediate value is substantially equal to said input value.

2. A method according to claim 1, wherein each of the pixels of the display includes at least two sub-pixels which are driven with out of phase halftone cycles.

3. A method according to claim 1, wherein adjacent pixels are driven in halftone cycles which are out of phase with respect to one another.

4. A method according to claim 1, wherein, in each halftone cycle there is formed a checkerboard pattern of extreme values of portions of the display.

5. A method as claimed in claim 1, wherein said extreme values comprise a fully-on pixel value and a fully-off pixel value.

6. A method according to claim 1, comprising the further step of:

detecting when the input value has changed around a midpoint value and altering the intermediate value to take into account the change so as to substantially maintain the average.

7. A method according to claim 1, further comprising overdriving said pixels during a fixed period for display of said pixels so as to produce a predetermined output intensity value of said pixels.

8. A method according to claim 1, wherein said halftone cycles correspond to respective fields within a video display signal.

9. An apparatus for halftoning an input signal intended for reproduction on a display having a plurality of pixels and a limited response time, said apparatus comprising:

first means for halftoning an input value for each pixel of said display to an extreme representable value in a first halftone cycle, the extreme representable value being a fixed value at the extreme end of a range of input values; and second means for halftoning the input value for the corresponding pixel in a second halftone cycle to an intermediate value such that an average between the extreme representable value and the intermediate value is substantially equal to the input value.

10. An apparatus according to claim 9, wherein each said pixel of said display includes at least two sub-pixels, said apparatus further comprising means for driving said subpixels with out-of-phase halftone cycles.

11. An apparatus according to claim 9, further comprising means for driving adjacent ones of said pixels in halftone cycles that are out-of-phase with respect to one another.

12. An apparatus according to claim 9, in which, for each halftone cycle, a checkerboard pattern of extreme values is formed by said display.

13. An apparatus according to claim 9, wherein said extreme value comprises one of a fully-on pixel or a fully-off pixel.

14. An apparatus according to claim 9, further comprising means for detecting when the input value changes about a midpoint of displayable values and for subsequently altering the intermediate value to take into account the change so as to substantially maintain the average.

15. An apparatus according to claim 9, further comprising means for overdriving display of said pixels during a fixed period for display of said pixels so as to produce a predetermined output intensity value of said pixels.

16. An apparatus according to claim 15, wherein said means for overdriving acts to compensate for the limited response time.

17. An apparatus according to claim 9, wherein said halftone cycles correspond to respective fields within a video display signal.

18. An apparatus according to claim 9, wherein said display is a liquid crystal display.

19. A system for displaying an image, said system comprising:

an image apparatus for providing an image signal;

a display having a plurality of pixels and a limited response time; and a halftoning apparatus coupled between said image apparatus and said display and configured to halftone the image signal so that a limited number of displayable intensity levels are provided to said display, said halftoning apparatus performing:

a first process of halftoning an input value, derived from the image signal for each pixel of said display, to an extreme one of the intensity levels during a first halftone cycle, the extreme one of the intensity levels being a fixed value at the extreme end of a range of input values; and a second process of halftoning the input value, for the corresponding pixel during a second halftone cycle, to an intermediate intensity level such that an average between the extreme intensity level and the intermediate intensity level is substantially equal to the input value.

20. A system according to claim 19, wherein the limited number of displayable intensity levels corresponds to a number of intensity levels able to be reproduced by said display.

21. A system according to claim 19, wherein the image signal is a video display signal and the halftone cycles correspond to respective fields of the video display signal.

22. A system according to claim 19, wherein said image apparatus comprises a computer system configured for at least providing the image formed as the signal and said halftoning apparatus is integral with said computer system.

23. A system according to claim 19, wherein said halftoning apparatus is integral with said display.

24. A system according to claim 19, wherein said display is a liquid crystal display.

25. A system according to claim 19, wherein each pixel of said display includes at least two sub-pixels, said halftoning apparatus further comprising means for driving said subpixels with out-of-phase halftone cycles.

26. A system according to claim 19, wherein said halftoning apparatus comprises means for driving adjacent ones of said pixels in halftone cycles that are out-of-phase with respect to one another.

27. A system according to claim 19, in which, for each halftone cycle, a checkerboard pattern of extreme values is formed by said display.

28. A system according to claim 19, wherein the extreme value comprises one of a fully-on pixel or a fully-off pixel.

29. A system according to claim 19, wherein said halftoning apparatus further comprises means for detecting when the input value changes about a midpoint of displayable values and for subsequently altering the intermediate value to take into account the change so as to substantially maintain the average.

30. A system according to claim 19, wherein said halftoning apparatus further comprises means for overdriving said pixels during a fixed period for display of said pixels so as to produce a predetermined output intensity value of said pixels.

31. A system according to claim 30, wherein said means for overdriving acts to compensate for the limited response time.

32. A computer readable medium incorporating a computer program product having a series of instructions for halftoning input image data intended for reproduction on a display having a plurality of pixels and a limited pixel response time, the series of instructions being configured to perform a method comprising, for each pixel of the display, the steps of:

in a first halftone cycle, (first) halftoning an input value to display an extreme representable value, the extreme representable value being a fixed value at the extreme end of a range of input values; and in a second halftone cycle, (second) halftoning the input value to display an intermediate value such that the average of the extreme representable value and the intermediate value is substantially equal to the input value.

33. A computer readable medium according to claim 32, wherein each of the pixels of the display includes at least two sub-pixels which are driven with out-of-phase halftone cycles.

34. A computer readable medium according to claim 32, wherein adjacent pixels are driven in halftone cycles which are out-of-phase with respect to one another.

35. A computer readable medium according to claim 32, wherein, in each halftone cycle there is formed a checkerboard pattern of extreme values of portions of the display.

36. A computer readable medium as claimed in claim 32, wherein said extreme values comprise a fully-on pixel value and a fully-off pixel value.

37. A computer readable medium according to claim 32, in which the method comprises the further step of:

detecting when the input value has changed around a midpoint value and altering the intermediate value to take into account the change so as to substantially maintain the average.

38. A computer readable medium according to claim 32, in which the method further comprises overdriving the pixels during a fixed period for display of the pixels so as to produce a predetermined output intensity of the pixels.

39. A computer readable medium according to claim 32, wherein the halftone cycles correspond to respective fields within a video display signal.

* * * * *

UNITED STATES PATENT AND TRADEMARK OFFICE

CERTIFICATE OF CORRECTION

PATENT NO. : 6,466,225 B1
DATED : October 15, 2002
INVENTOR(S) : Kieran Gerard Larkin et al.

It is certified that error appears in the above-identified patent and that said Letters Patent is hereby corrected as shown below:

Column 2,
Line 28, “illustrates” should read -- illustrate --.

Column 3,
Line 29, “depicted” should read -- depicted in --;
Line 33, “field (k=2),” should read -- field (K=2), --; and
Line 47, “over driven” should read -- overdriven --.

Column 4,
Line 9, “mid point” should read -- mid-point --.

Column 5,
Line 5, “midpoint” should read -- mid-point --.

Column 6,
Line 11, “94 transition).” should read -- 94% transition). --;
Line 41, “conversation” should read -- conversion --; and
Line 57, “above described” should read -- above-described --.

Column 7,
Lines 1, 17 and 30, “The” should read -- ¶ The --;
Line 46, “alike” should read -- like --;
Line 47, “Typically,” should read -- ¶ Typically, --.

UNITED STATES PATENT AND TRADEMARK OFFICE

CERTIFICATE OF CORRECTION

PATENT NO. : 6,466,225 B1
DATED : October 15, 2002
INVENTOR(S) : Kieran Gerard Larkin et al.

It is certified that error appears in the above-identified patent and that said Letters Patent is hereby corrected as shown below:

Column 8,
Line 1, "The" should read -- ¶ The --;
Lines 5 and 10, "It" should read -- ¶ It --.

Signed and Sealed this

Tenth Day of June, 2003

JAMES E. ROGAN
*Director of the United States Patent and Trademark Office*